US009041297B2

(12) United States Patent
Burrows et al.

(10) Patent No.: US 9,041,297 B2
(45) Date of Patent: May 26, 2015

(54) LARGE AREA LIGHTING SYSTEM WITH WIRELESS CONTROL

(71) Applicant: Universal Display Corporation, Ewing, NJ (US)

(72) Inventors: Paul E. Burrows, Chattaroy, WA (US); Ruiqing Ma, Morristown, NJ (US); Jason Paynter, Bristol, PA (US); Michael O'Connor, Ewing, NJ (US); Julia J. Brown, Yardley, PA (US)

(73) Assignee: UNIVERSAL DISPLAY CORPORATION, Ewing, NJ (US)

( * ) Notice: Subject to any disclaimer, the term of this patent is extended or adjusted under 35 U.S.C. 154(b) by 0 days.

(21) Appl. No.: 13/926,792

(22) Filed: Jun. 25, 2013

(65) Prior Publication Data

US 2014/0339987 A1 Nov. 20, 2014

Related U.S. Application Data

(60) Provisional application No. 61/825,214, filed on May 20, 2013.

(51) Int. Cl.
*H05B 37/02* (2006.01)
*H05B 33/08* (2006.01)

(52) U.S. Cl.
CPC ..... *H05B 33/0896* (2013.01)

(58) Field of Classification Search
USPC ..... 315/153, 158, 308, 312; 345/204, 207, 345/690
See application file for complete search history.

(56) References Cited

U.S. PATENT DOCUMENTS

| | | | |
|---|---|---|---|
| 4,769,292 | A | 9/1988 | Tang et al. |
| 5,247,190 | A | 9/1993 | Friend et al. |
| 5,703,436 | A | 12/1997 | Forrest et al. |
| 5,707,745 | A | 1/1998 | Forrest et al. |
| 5,834,893 | A | 11/1998 | Bulovic et al. |
| 5,844,363 | A | 12/1998 | Gu et al. |
| 6,013,982 | A | 1/2000 | Thompson et al. |
| 6,087,196 | A | 7/2000 | Sturm et al. |
| 6,091,195 | A | 7/2000 | Forrest et al. |

(Continued)

FOREIGN PATENT DOCUMENTS

| | | |
|---|---|---|
| WO | 2008057394 | 5/2008 |
| WO | 2010011390 | 1/2010 |

(Continued)

OTHER PUBLICATIONS

Baldo, et al., "Highly efficient phosphorescent emission from organic electroluminescent devices", Nature, vol. 395, pp. 151-154, 1998.

(Continued)

*Primary Examiner* — Tung X Le
(74) *Attorney, Agent, or Firm* — Morris & Kamlay LLP

(57) ABSTRACT

Sensors and lighting components are provided that are capable of matching an emitted color to a color observed at a remote location. The sensor measures a light characteristic at a first location, and provides data to a remote lighting component, such as via a wireless connection. The lighting component is configured to emit light based upon the light characteristic, and thus is able to match an observed lighting condition. The lighting component may match the color, intensity, temperature, pattern, texture, or other characteristic of light at a remote location.

28 Claims, 6 Drawing Sheets

(56) References Cited

U.S. PATENT DOCUMENTS

| | | | | |
|---|---|---|---|---|
| 6,097,147 | A | 8/2000 | Baldo et al. | |
| 6,294,398 | B1 | 9/2001 | Kim et al. | |
| 6,303,238 | B1 | 10/2001 | Thompson et al. | |
| 6,337,102 | B1 | 1/2002 | Forrest et al. | |
| 6,468,819 | B1 | 10/2002 | Kim et al. | |
| 6,776,496 | B2 | 8/2004 | Cok | |
| 6,787,990 | B2 | 9/2004 | Cok | |
| 7,279,704 | B2 | 10/2007 | Walters et al. | |
| 7,431,968 | B1 | 10/2008 | Shtein et al. | |
| 7,598,686 | B2 | 10/2009 | Lys et al. | |
| 7,968,146 | B2 | 6/2011 | Wagner et al. | |
| 8,258,454 | B2 | 9/2012 | Verschuren | |
| 8,729,833 | B2 * | 5/2014 | Chemel et al. | 315/308 |
| 2003/0230980 | A1 | 12/2003 | Forrest et al. | |
| 2004/0174116 | A1 | 9/2004 | Lu et al. | |
| 2010/0253229 | A1 | 10/2010 | Verschuren | |
| 2011/0187668 | A1 | 8/2011 | Hente | |
| 2012/0274602 | A1 * | 11/2012 | Bita et al. | 345/174 |
| 2013/0285558 | A1 * | 10/2013 | Recker et al. | 315/153 |

FOREIGN PATENT DOCUMENTS

| | | | |
|---|---|---|---|
| WO | 2010038179 | A2 | 4/2010 |
| WO | 2010125496 | A1 | 11/2010 |

OTHER PUBLICATIONS

Baldo, et al., "Very high-efficiency green organic light-emitting devices based on electrophosphorescence", Applied Physics Letters, vol. 75, No. 1, pp. 4-6, Jul. 5, 1999.

Knight, "Chameleon Scarf Coordinates With Your Outfit", New Scientist, available at http://www.newscientist.com/article/dn8440-chameleon-scarf-coordinates-with-your-outfit.html (last visited Feb. 7, 2013), Dec. 9, 2005.

VAT19, "Huey the Color-Changing Chameleon LED Lamp", available at http://www.vat19.com/dvds/huey-color-copying-chameleon-lamp.cfm (last visited Feb. 7, 2013), Feb. 7, 2013.

* cited by examiner

LARGE AREA LIGHTING SYSTEM WITH WIRELESS CONTROL

PRIORITY

This application claims priority to U.S. Provisional Patent Application No. 61/825,214, filed May 20, 2013, the disclosure of which is incorporated by reference in its entirety.

The claimed invention was made by, on behalf of, and/or in connection with one or more of the following parties to a joint university corporation research agreement: Regents of the University of Michigan, Princeton University, The University of Southern California, and the Universal Display Corporation. The agreement was in effect on and before the date the claimed invention was made, and the claimed invention was made as a result of activities undertaken within the scope of the agreement.

FIELD OF THE INVENTION

The present invention relates to organic light emitting devices (OLEDs) and, more specifically, to systems including OLED lighting components in communication with remote sensors.

BACKGROUND

Opto-electronic devices that make use of organic materials are becoming increasingly desirable for a number of reasons. Many of the materials used to make such devices are relatively inexpensive, so organic opto-electronic devices have the potential for cost advantages over inorganic devices. In addition, the inherent properties of organic materials, such as their flexibility, may make them well suited for particular applications such as fabrication on a flexible substrate. Examples of organic opto-electronic devices include organic light emitting devices (OLEDs), organic phototransistors, organic photovoltaic cells, and organic photodetectors. For OLEDs, the organic materials may have performance advantages over conventional materials. For example, the wavelength at which an organic emissive layer emits light may generally be readily tuned with appropriate dopants.

OLEDs make use of thin organic films that emit light when voltage is applied across the device. OLEDs are becoming an increasingly interesting technology for use in applications such as flat panel displays, illumination, and backlighting. Several OLED materials and configurations are described in U.S. Pat. Nos. 5,844,363, 6,303,238, and 5,707,745, which are incorporated herein by reference in their entirety.

One application for phosphorescent emissive molecules is a full color display. Industry standards for such a display call for pixels adapted to emit particular colors, referred to as "saturated" colors. In particular, these standards call for saturated red, green, and blue pixels. Color may be measured using CIE coordinates, which are well known to the art.

One example of a green emissive molecule is tris(2-phenylpyridine) iridium, denoted $Ir(ppy)_3$, which has the following structure:

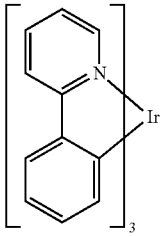

In this, and later figures herein, we depict the dative bond from nitrogen to metal (here, Ir) as a straight line.

As used herein, the term "organic" includes polymeric materials as well as small molecule organic materials that may be used to fabricate organic opto-electronic devices. "Small molecule" refers to any organic material that is not a polymer, and "small molecules" may actually be quite large. Small molecules may include repeat units in some circumstances. For example, using a long chain alkyl group as a substituent does not remove a molecule from the "small molecule" class. Small molecules may also be incorporated into polymers, for example as a pendent group on a polymer backbone or as a part of the backbone. Small molecules may also serve as the core moiety of a dendrimer, which consists of a series of chemical shells built on the core moiety. The core moiety of a dendrimer may be a fluorescent or phosphorescent small molecule emitter. A dendrimer may be a "small molecule," and it is believed that all dendrimers currently used in the field of OLEDs are small molecules.

As used herein, "top" means furthest away from the substrate, while "bottom" means closest to the substrate. Where a first layer is described as "disposed over" a second layer, the first layer is disposed further away from substrate. There may be other layers between the first and second layer, unless it is specified that the first layer is "in contact with" the second layer. For example, a cathode may be described as "disposed over" an anode, even though there are various organic layers in between.

As used herein, "solution processible" means capable of being dissolved, dispersed, or transported in and/or deposited from a liquid medium, either in solution or suspension form.

A ligand may be referred to as "photoactive" when it is believed that the ligand directly contributes to the photoactive properties of an emissive material. A ligand may be referred to as "ancillary" when it is believed that the ligand does not contribute to the photoactive properties of an emissive material, although an ancillary ligand may alter the properties of a photoactive ligand.

As used herein, and as would be generally understood by one skilled in the art, a first "Highest Occupied Molecular Orbital" (HOMO) or "Lowest Unoccupied Molecular Orbital" (LUMO) energy level is "greater than" or "higher than" a second HOMO or LUMO energy level if the first energy level is closer to the vacuum energy level. Since ionization potentials (IP) are measured as a negative energy relative to a vacuum level, a higher HOMO energy level corresponds to an IP having a smaller absolute value (an IP that is less negative). Similarly, a higher LUMO energy level corresponds to an electron affinity (EA) having a smaller absolute value (an EA that is less negative). On a conventional energy level diagram, with the vacuum level at the top, the LUMO energy level of a material is higher than the HOMO energy level of the same material. A "higher" HOMO or LUMO energy level appears closer to the top of such a diagram than a "lower" HOMO or LUMO energy level.

As used herein, and as would be generally understood by one skilled in the art, a first work function is "greater than" or "higher than" a second work function if the first work function has a higher absolute value. Because work functions are generally measured as negative numbers relative to vacuum level, this means that a "higher" work function is more negative. On a conventional energy level diagram, with the vacuum level at the top, a "higher" work function is illustrated as further away from the vacuum level in the downward direction. Thus, the definitions of HOMO and LUMO energy levels follow a different convention than work functions.

More details on OLEDs, and the definitions described above, can be found in U.S. Pat. No. 7,279,704, which is incorporated herein by reference in its entirety.

SUMMARY OF THE INVENTION

Devices and techniques for generating light having one or more characteristics are provided.

In an embodiment, a system for providing light having a desired characteristic includes a sensor component and a lighting component. The sensor component may include a sensor configured to measure a physical characteristic, and a wireless transmitter configured to provide a sensor signal based upon the physical characteristic, which specifies a desired light characteristic. The lighting component may include an OLED, such as a color-tunable OLED, a wireless receiver configured to receive the sensor signal, and a controller configured to provide a control signal to the OLED. The control signal may specify the desired light characteristic, thus causing the OLED to emit light having the desired light characteristic. The sensor may receive the sensor signal in real-time, and/or the control signal may specify the desired light characteristic in real time based upon the physical characteristic. The desired light characteristic may be, for example, a color, an intensity, a temperature, and/or a pattern.

In an embodiment, a device is provided that includes an OLED, such as a color-tunable OLED, a wireless receiver configured to receive a signal from a remote sensor in real-time, which specifies a desired light characteristic resulting from an automatic measurement, by the sensor, of a physical characteristic measured by the remote sensor in real-time, and a controller configured to provide a control signal to the color-tunable OLED specifying the desired light characteristic in real-time, which causes the color-tunable OLED to emit light having the desired light characteristic.

In an embodiment, the sensor component also may include a reference reflector, such that the physical characteristic is an attribute of light reflected by the reference reflector. The sensor component also may include a reference light source, such that the physical characteristic is an attribute of the reference light reflected by the reference reflector.

In an embodiment, the sensor component may be portable and/or include a battery power source.

In an embodiment, the OLED may be configured to emit light having the desired light characteristic by emitting light of a plurality of colors having an intensity distribution based upon a desired color.

In an embodiment, a system as disclosed may include multiple lighting components, each which includes an OLED, a wireless receiver, and a controller configured to provide a control signal to the OLED specifying the desired light characteristic in real-time, where the control signal causes the OLED to emit light having the desired light characteristic. The signal received by each wireless receiver may be the sensor signal, or it may be another signal received from another lighting component, a central controller, or the like.

In an embodiment, the system may include a replacement lighting component, such that upon addition of the replacement lighting component, the replacement lighting component receives the signal and emits light defined by the signal in real-time. The light defined by the signal may be based upon light emitted by at least one of the lighting components.

In an embodiment, one or more lighting components may include a mechanism configured to position the lighting component to generate a visible pattern defined by the desired light characteristic.

In various embodiments, each may be flexible, partially or entirely transparent, and/or include a large-area OLED panel.

DETAILED DESCRIPTION

Generally, an OLED comprises at least one organic layer disposed between and electrically connected to an anode and a cathode. When a current is applied, the anode injects holes and the cathode injects electrons into the organic layer(s). The injected holes and electrons each migrate toward the oppositely charged electrode. When an electron and hole localize on the same molecule, an "exciton," which is a localized electron-hole pair having an excited energy state, is formed. Light is emitted when the exciton relaxes via a photoemissive mechanism. In some cases, the exciton may be localized on an excimer or an exciplex. Non-radiative mechanisms, such as thermal relaxation, may also occur, but are generally considered undesirable.

The initial OLEDs used emissive molecules that emitted light from their singlet states ("fluorescence") as disclosed, for example, in U.S. Pat. No. 4,769,292, which is incorporated by reference in its entirety. Fluorescent emission generally occurs in a time frame of less than 10 nanoseconds.

More recently, OLEDs having emissive materials that emit light from triplet states ("phosphorescence") have been demonstrated. Baldo et al., "Highly Efficient Phosphorescent Emission from Organic Electroluminescent Devices,"

Nature, vol. 395, 151-154, 1998; ("Baldo-I") and Baldo et al., "Very high-efficiency green organic light-emitting devices based on electrophosphorescence," Appl. Phys. Lett., vol. 75, No. 3, 4-6 (1999) ("Baldo-II"), which are incorporated by reference in their entireties. Phosphorescence is described in more detail in U.S. Pat. No. 7,279,704 at cols. 5-6, which are incorporated by reference.

Figure 1:
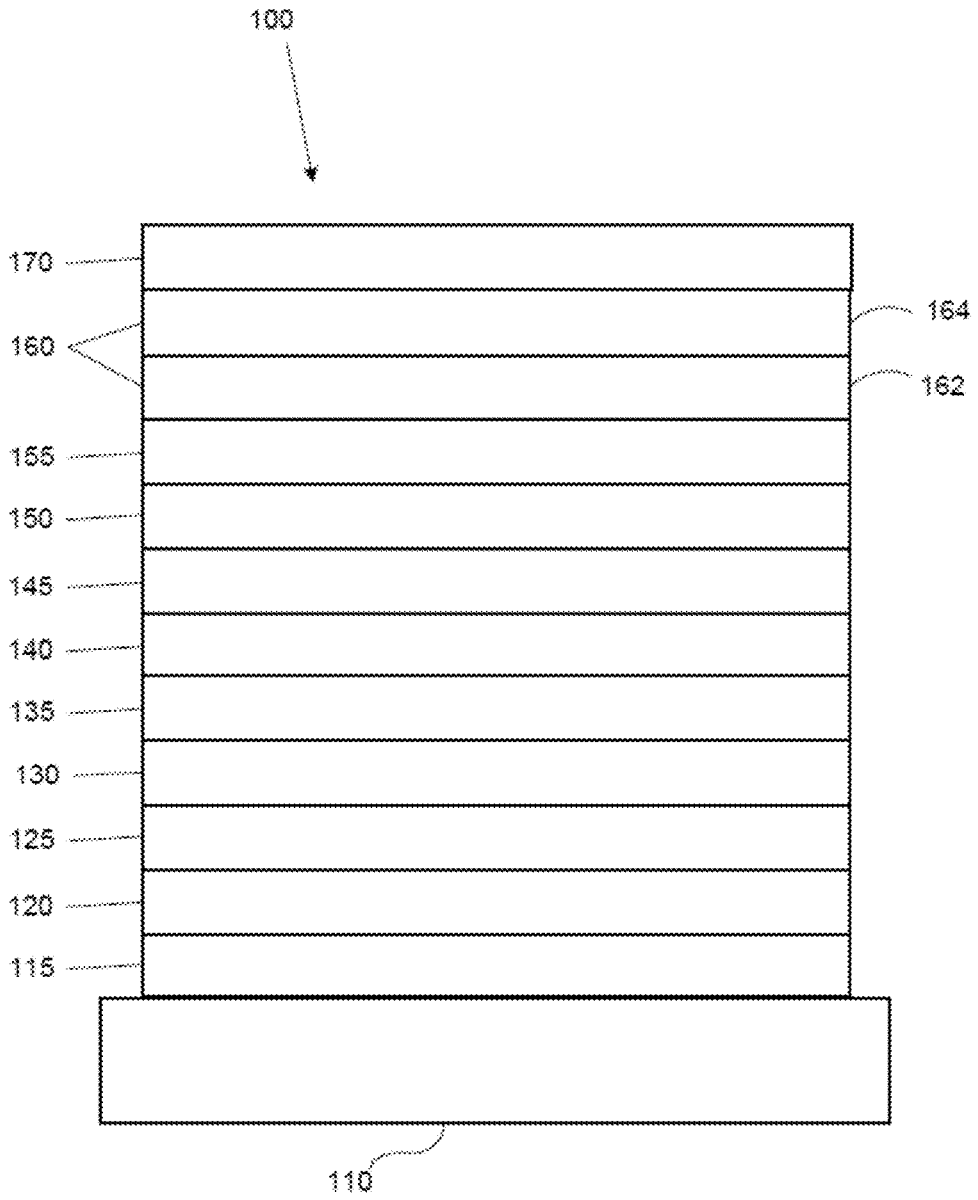
FIG. 1 shows an organic light emitting device.

FIG. 1 shows an organic light emitting device 100. The figures are not necessarily drawn to scale. Device 100 may include a substrate 110, an anode 115, a hole injection layer 120, a hole transport layer 125, an electron blocking layer 130, an emissive layer 135, a hole blocking layer 140, an electron transport layer 145, an electron injection layer 150, a protective layer 155, a cathode 160, and a barrier layer 170. Cathode 160 is a compound cathode having a first conductive layer 162 and a second conductive layer 164. Device 100 may be fabricated by depositing the layers described, in order. The properties and functions of these various layers, as well as example materials, are described in more detail in U.S. Pat. No. 7,279,704 at cols. 6-10, which are incorporated by reference.

More examples for each of these layers are available. For example, a flexible and transparent substrate-anode combination is disclosed in U.S. Pat. No. 5,844,363, which is incorporated by reference in its entirety. An example of a p-doped hole transport layer is m-MTDATA doped with $F_4$-TCNQ at a molar ratio of 50:1, as disclosed in U.S. Patent Application Publication No. 2003/0230980, which is incorporated by reference in its entirety. Examples of emissive and host materials are disclosed in U.S. Pat. No. 6,303,238 to Thompson et al., which is incorporated by reference in its entirety. An example of an n-doped electron transport layer is BPhen doped with Li at a molar ratio of 1:1, as disclosed in U.S. Patent Application Publication No. 2003/0230980, which is incorporated by reference in its entirety. U.S. Pat. Nos. 5,703,436 and 5,707,745, which are incorporated by reference in their entireties, disclose examples of cathodes including compound cathodes having a thin layer of metal such as Mg:Ag with an overlying transparent, electrically-conductive, sputter-deposited ITO layer. The theory and use of blocking layers is described in more detail in U.S. Pat. No. 6,097,147 and U.S. Patent Application Publication No. 2003/0230980, which are incorporated by reference in their entireties. Examples of injection layers are provided in U.S. Patent Application Publication No. 2004/0174116, which is incorporated by reference in its entirety. A description of protective layers may be found in U.S. Patent Application Publication No. 2004/0174116, which is incorporated by reference in its entirety.

Figure 2:
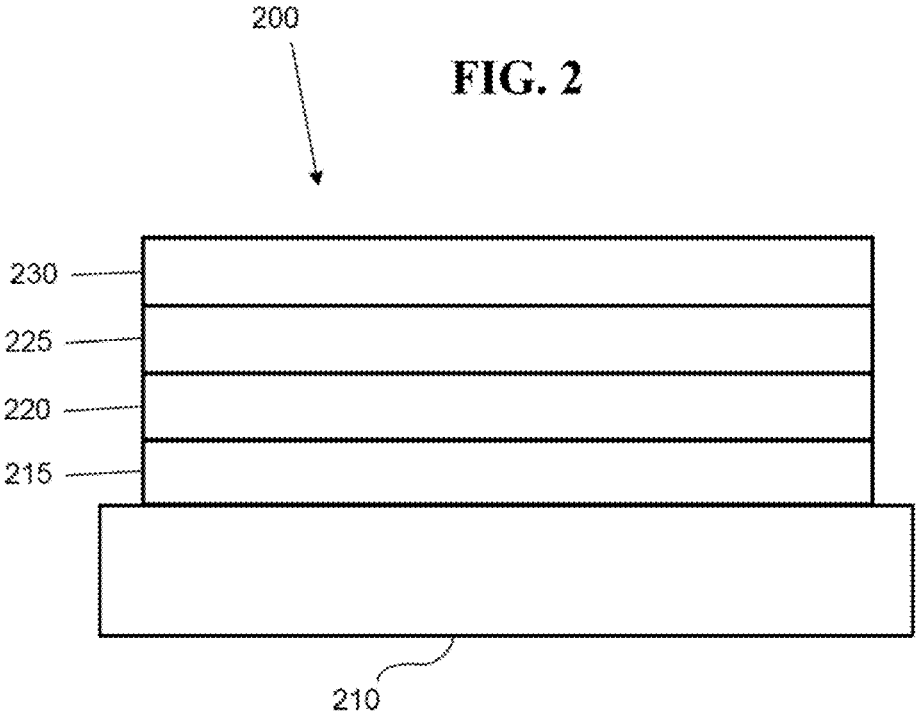
FIG. 2 shows an inverted organic light emitting device that does not have a separate electron transport layer.

FIG. 2 shows an inverted OLED 200. The device includes a substrate 210, a cathode 215, an emissive layer 220, a hole transport layer 225, and an anode 230. Device 200 may be fabricated by depositing the layers described, in order. Because the most common OLED configuration has a cathode disposed over the anode, and device 200 has cathode 215 disposed under anode 230, device 200 may be referred to as an "inverted" OLED. Materials similar to those described with respect to device 100 may be used in the corresponding layers of device 200. FIG. 2 provides one example of how some layers may be omitted from the structure of device 100.

The simple layered structure illustrated in FIGS. 1 and 2 is provided by way of non-limiting example, and it is understood that embodiments of the invention may be used in connection with a wide variety of other structures. The specific materials and structures described are exemplary in nature, and other materials and structures may be used. Functional OLEDs may be achieved by combining the various layers described in different ways, or layers may be omitted entirely, based on design, performance, and cost factors. Other layers not specifically described may also be included. Materials other than those specifically described may be used. Although many of the examples provided herein describe various layers as comprising a single material, it is understood that combinations of materials, such as a mixture of host and dopant, or more generally a mixture, may be used. Also, the layers may have various sublayers. The names given to the various layers herein are not intended to be strictly limiting. For example, in device 200, hole transport layer 225 transports holes and injects holes into emissive layer 220, and may be described as a hole transport layer or a hole injection layer. In one embodiment, an OLED may be described as having an "organic layer" disposed between a cathode and an anode. This organic layer may comprise a single layer, or may further comprise multiple layers of different organic materials as described, for example, with respect to FIGS. 1 and 2.

Structures and materials not specifically described may also be used, such as OLEDs comprised of polymeric materials (PLEDs) such as disclosed in U.S. Pat. No. 5,247,190 to Friend et al., which is incorporated by reference in its entirety. By way of further example, OLEDs having a single organic layer may be used. OLEDs may be stacked, for example as described in U.S. Pat. No. 5,707,745 to Forrest et al, which is incorporated by reference in its entirety. The OLED structure may deviate from the simple layered structure illustrated in FIGS. 1 and 2. For example, the substrate may include an angled reflective surface to improve out-coupling, such as a mesa structure as described in U.S. Pat. No. 6,091,195 to Forrest et al., and/or a pit structure as described in U.S. Pat. No. 5,834,893 to Bulovic et al., which are incorporated by reference in their entireties.

Unless otherwise specified, any of the layers of the various embodiments may be deposited by any suitable method. For the organic layers, preferred methods include thermal evaporation, ink-jet, such as described in U.S. Pat. Nos. 6,013,982 and 6,087,196, which are incorporated by reference in their entireties, organic vapor phase deposition (OVPD), such as described in U.S. Pat. No. 6,337,102 to Forrest et al., which is incorporated by reference in its entirety, and deposition by organic vapor jet printing (OVJP), such as described in U.S. Pat. No. 7,431,968, which is incorporated by reference in its entirety. Other suitable deposition methods include spin coating and other solution based processes. Solution based processes are preferably carried out in nitrogen or an inert atmosphere. For the other layers, preferred methods include thermal evaporation. Preferred patterning methods include deposition through a mask, cold welding such as described in U.S. Pat. Nos. 6,294,398 and 6,468,819, which are incorporated by reference in their entireties, and patterning associated with some of the deposition methods such as ink-jet and OVJP. Other methods may also be used. The materials to be deposited may be modified to make them compatible with a particular deposition method. For example, substituents such as alkyl and aryl groups, branched or unbranched, and preferably containing at least 3 carbons, may be used in small molecules to enhance their ability to undergo solution processing. Substituents having 20 carbons or more may be used, and 3-20 carbons is a preferred range. Materials with asymmetric structures may have better solution processibility than those having symmetric structures, because asymmetric materials may have a lower tendency to recrystallize. Dendrimer substituents may be used to enhance the ability of small molecules to undergo solution processing.

Devices fabricated in accordance with embodiments of the present invention may further optionally comprise a barrier layer. One purpose of the barrier layer is to protect the electrodes and organic layers from damaging exposure to harmful species in the environment including moisture, vapor and/or gases, etc. The barrier layer may be deposited over, under or next to a substrate, an electrode, or over any other parts of a device including an edge. The barrier layer may comprise a single layer, or multiple layers. The barrier layer may be formed by various known chemical vapor deposition techniques and may include compositions having a single phase as well as compositions having multiple phases. Any suitable material or combination of materials may be used for the barrier layer. The barrier layer may incorporate an inorganic or an organic compound or both. The preferred barrier layer comprises a mixture of a polymeric material and a non-polymeric material as described in U.S. Pat. No. 7,968,146, PCT Pat. Application Nos. PCT/US2007/023098 and PCT/US2009/042829, which are herein incorporated by reference in their entireties. To be considered a "mixture", the aforesaid polymeric and non-polymeric materials comprising the barrier layer should be deposited under the same reaction conditions and/or at the same time. The weight ratio of polymeric to non-polymeric material may be in the range of 95:5 to 5:95. The polymeric material and the non-polymeric material may be created from the same precursor material. In one example, the mixture of a polymeric material and a non-polymeric material consists essentially of polymeric silicon and inorganic silicon.

Devices fabricated in accordance with embodiments of the invention may be incorporated into a wide variety of consumer products, including flat panel displays, computer monitors, medical monitors, televisions, billboards, lights for interior or exterior illumination and/or signaling, heads up displays, fully transparent displays, flexible displays, laser printers, telephones, cell phones, personal digital assistants (PDAs), laptop computers, digital cameras, camcorders, viewfinders, micro-displays, 3-D displays, vehicles, a large area wall, theater or stadium screen, or a sign. Various control mechanisms may be used to control devices fabricated in accordance with the present invention, including passive matrix and active matrix. Many of the devices are intended for use in a temperature range comfortable to humans, such as 18 degrees C. to 30 degrees C., and more preferably at room temperature (20-25 degrees C.), but could be used outside this temperature range, for example, from −40 degree C. to +80 degree C.

The materials and structures described herein may have applications in devices other than OLEDs. For example, other optoelectronic devices such as organic solar cells and organic photodetectors may employ the materials and structures. More generally, organic devices, such as organic transistors, may employ the materials and structures.

The terms halo, halogen, alkyl, cycloalkyl, alkenyl, alkynyl, aralkyl, heterocyclic group, aryl, aromatic group, and heteroaryl are known to the art, and are defined in U.S. Pat. No. 7,279,704 at cols. 31-32, which are incorporated herein by reference.

Various devices are known that use a color sensor in combination with one or more LEDs to match a desired color. For example, novelty toys such as disclosed in "Huey the Color-Changing Chameleon LED Lamp," available at http://www.vat19.com/dvds/huey-color-copying-chameleon-lamp.cfm, use a hollow translucent plastic shell containing red, blue and green LEDs with a color sensor affixed to the underside. The color of light emitted by the device matches the color of the surface on which it sits. Another device is described in "Chameleon scarf coordinates with your outfit," available at http://www.newscientist.com/article/dn8440-chameleon-scarf-coordinates-with-your-outfit.html, which includes a scarf that automatically coordinates its color with an adjacent article of clothing by tuning an array of LEDs embedded in the fabric. Similarly, PCT application WO 2007/072352 discloses a pair of color-tunable eyeglasses with color-matching functionality. Each of these devices relies upon a color sensor to match or co-ordinate the color of an object to that of a nearby surface. However, neither appears to be used for a large-area lighting application, partly because these devices use LEDs, and partly because each color sensing unit appears to be directly connected to the LED control system.

In contrast, embodiments of the present invention enable OLEDs to work as a dynamic lighting system for general illumination. This is made possible in part by the development of a color detector that can be remotely located from and placed in wireless communication with the illumination source, thus allowing the sensor to be independent of the illumination source itself or to be used as an intuitive color input system. For example, such a detector may serve as an input to a dynamic quality lighting system, rather than simply reproducing a color that it is located on or nearby.

Some general illumination devices provide the capability for a fixture to provide light of a desired color, such as described in U.S. Pat. Nos. 7,598,686, 6,776,496, and 6,787,990. Such devices generally describe individual fixtures, which lack real-time color tuning capability to affect the quality of large area illumination. They also require the use of a fixture into which an emissive device such as an OLED panel is inserted and removed as required. In contrast, embodiments of the present invention do not require a separate fixture. Some embodiments may be integrated into a luminaire and may be battery powered, inductively coupled to a remote power loop, or plugged into a power outlet. The absence of a "light bulb" analog that is removably inserted into a fixture may increase the functionality of embodiments disclosed herein. For example, OLEDs disclosed herein may be placed anywhere on a wall or a ceiling, or may be free standing within a room, being effectively divorced from the requirement of placing them in a particular location defined by a power connection.

U.S. Patent Application Pub. No. 2010/0253229 describes a remote control for an OLED which also functions as a light detector. However, the systems disclosed therein do not provide color tunability or input methods and systems as disclosed herein. U.S. Patent Application Pub. No. 2011/0187668 and WO 2010/038179 describe proximity sensors that control an array of OLEDs, such as by way of an illuminated mirror that reflects an approaching body with a responsive pattern of illumination. Such devices do not provide any means of remote input to control the color of one or more OLED luminaires. WO/2010/125496 describes an OLED that senses daylight to determine whether the OLED should be activated. The disclosed system uses the OLED itself as a photodetector, which is inefficient, and fails to provide any mechanism for color control of the OLED.

Some systems, such as the "Hue" system provided by Philips and described at http://www.meethue.com/en-US, offer options for control of color-tunable LED lighting. However, such systems require a user to select a specific desired color, for example by selecting a desired color from a smartphone palette. In contrast, the systems and techniques disclosed herein do not require specific color selection by a user, thus providing for more reliable color matching, such as when operated by a color-blind person.

Embodiments of the invention provide systems and techniques for interior lighting that allows for color selection based upon remote measurements of, for example, ambient color. For example, an interior lighting system according to an embodiment may mimic the quality of exterior light by automatically varying the interior color temperature from high (at noon) to low (at sunset). As another example, the color quality of light from multiple luminaires in a system may be managed automatically, thereby reducing color binning problems that may result in relamping and other situations.

Figure 3:
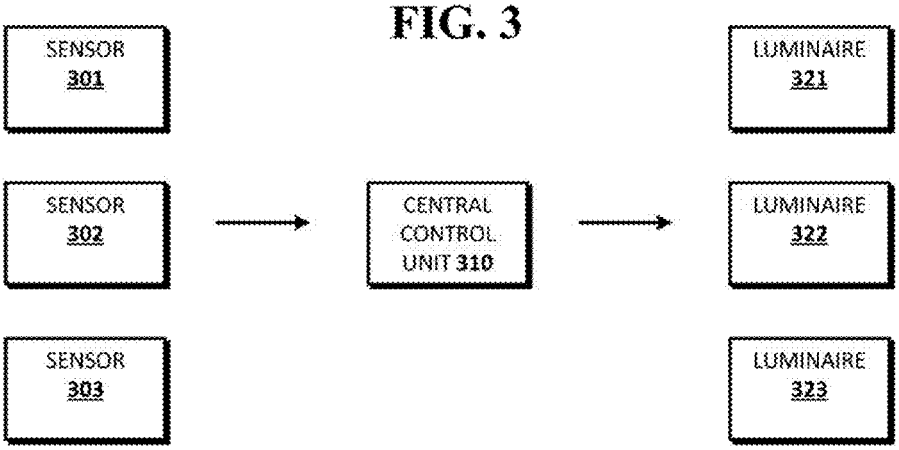
FIG. 3 shows a schematic representation of a system and devices according to an embodiment of the invention.

FIG. 3 shows a schematic representation of a system according to an embodiment of the invention. One or more sensors 301, 302, 303 may be positioned to detect characteristics of light in a desired location, such as within a room, outside a building, near one or more lighting devices that are to be color matched, or the like. The sensors may be battery powered and may include wireless communication capabilities as described in further detail herein. Each sensor may communicate directly with one or more luminaires 321, 322, 323, which are able to produce a desired color based upon the characteristics measured by the sensors. In some embodiments, each sensor may communicate with a single luminaire, while in others, each sensor may communicate with multiple luminaires, and/or each luminaire may receive characteristic data from one or more sensors. For example, each sensor may detect characteristics of light in a region outside a building and communicate this data to a luminaire inside the building, which then produces light matching the color, temperature, intensity, or and/or other characteristic of the outdoor light. The luminaires may include wireless communication capabilities and/or a main control unit as described in further detail herein. In some embodiments, an optional central control unit 310 may be used to collect and manipulate information from the one or more sensors 301, 302, 303, such as where it is desired to match a complex arrangement of interior lighting to various outdoor lighting conditions, and each individual sensor 301, 302, 303 may not be able to provide complete information about the outdoor lighting conditions that is sufficient to produce the desired effect with the luminaires 321, 322, 323. The central control unit may operate in the same manner as disclosed herein with respect to the individual luminaires, by providing the necessary lighting information to each luminaire 321, 322, 323, which otherwise would be calculated by the individual luminaires.

Figure 4:
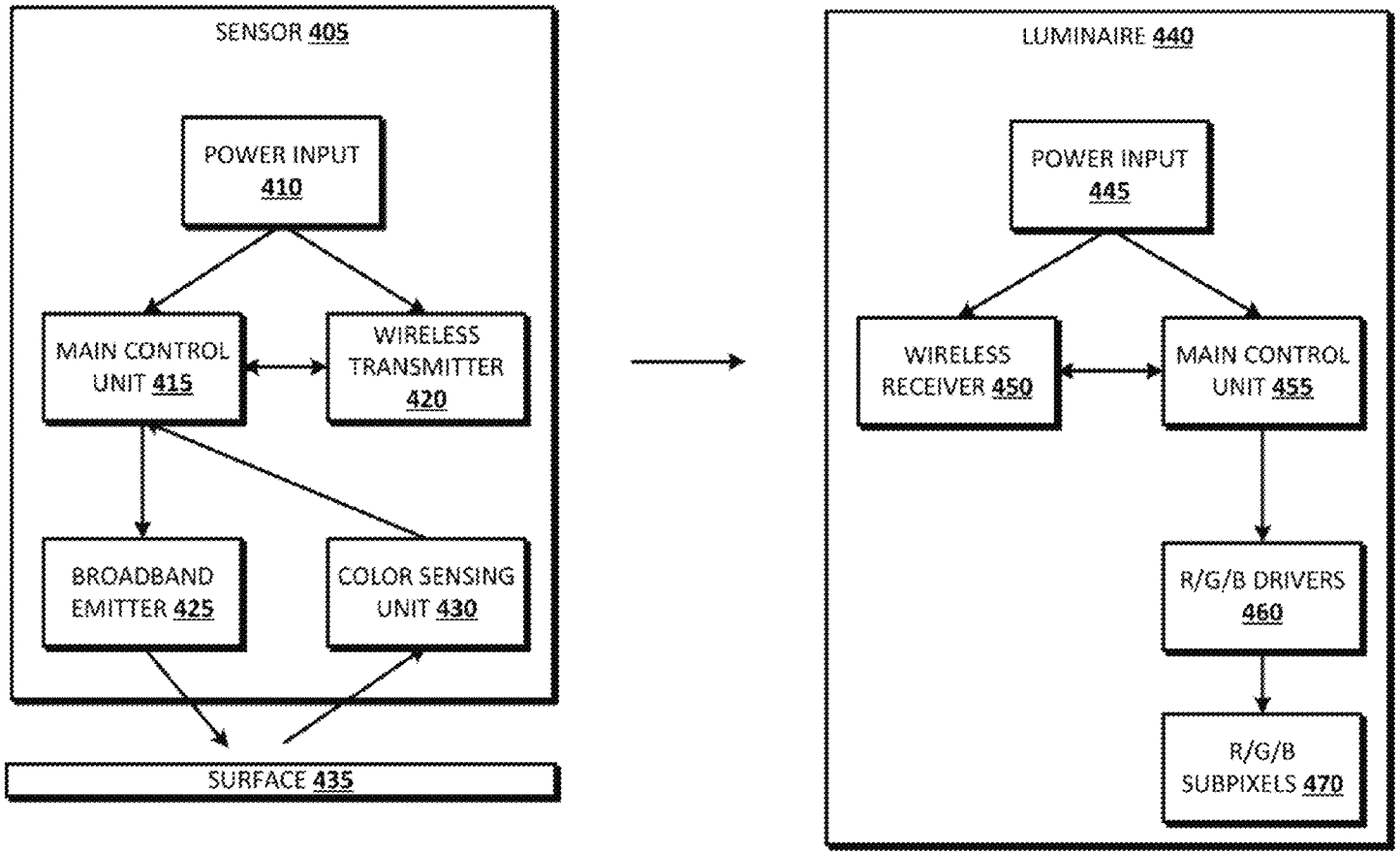
FIG. 4 shows a block diagram of an example device according to an embodiment of the invention.
Figure 8:
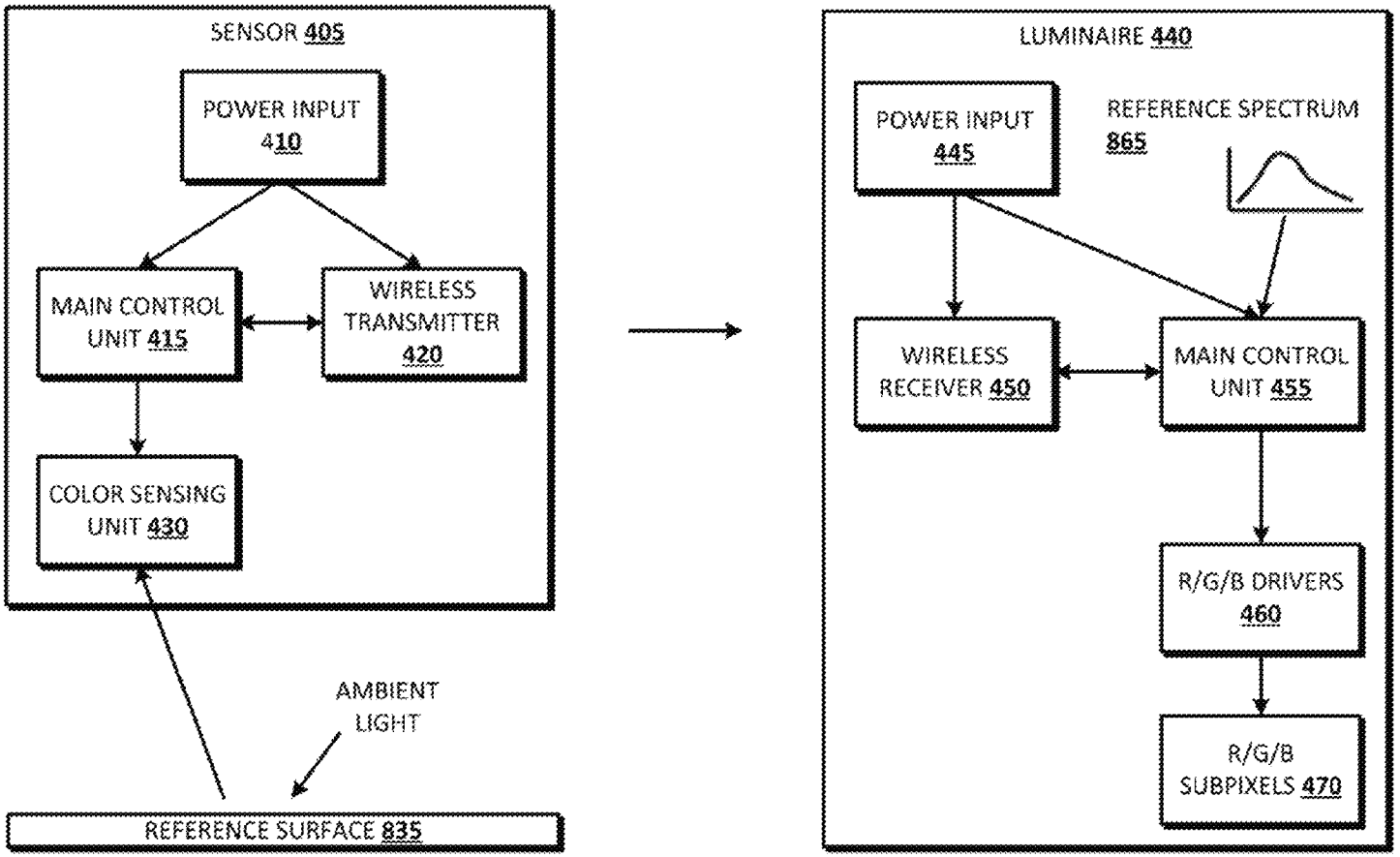
FIG. 8 shows a block diagram of an example device according to an embodiment of the invention.

FIG. 4 and FIG. 8 show schematic representations of sensor/luminaire systems according to embodiments of the invention. Although a single sensor/luminaire pair is shown in each, it will be understood that multiple sensors and/or luminaires may be used.

The sensor 405 includes a broadband light source 425, a color detector 430, and a wireless transmitter 420. The broadband light source may emit light toward a surface 435. The color sensing unit 430 receives light reflected by the surface 435, and may measure various characteristics of the light such as color, temperature, intensity, pattern, and the like. The measurements may then be provided to a processor such as the main control unit 415. Based upon data received from the color sensing unit 430, the main control unit 415 may determine characteristics of light to be emitted by a luminaire that will cause the emitted light to vary depending on the ambient light received from the surface 435. For example, the main control unit 415 may compare a color measurement obtained by the color sensing unit 420 to the known color of the broadband light emitted by the emitter 425, and determine the ambient light color based upon the difference between the two. In an embodiment, the surface may be a reference surface 835 with known color, reflectance, or other properties. The broadband source 425 may be omitted in such a configuration, because the main control unit 415 may be configured to determine desired light characteristics based upon the characteristics measured by the sensing unit 430 in comparison to the known characteristics of the reference surface 835.

The sensor 405 also may include a wireless transmitter 420, which may include a Bluetooth(R), WiFi, or other suitable wireless transmitter or transceiver. The sensor 405 may use the wireless transmitter 420 to provide instructions to one or more luminaires 440 sufficient for the luminaire 440 to emit light having the characteristic determined by the main control unit 415. For example, where the system is configured to match the color of outdoor light, the sensor 405 may transmit appropriate color information to the luminaire 440 that is sufficient for the luminaire to emit light of the same color as the outdoor light, as determined by the main control unit 415.

The sensor 405 also may include a power unit 410, such as an internal battery, external power supply, or connection to an available power source such as a conventional power connector suitable for connection to a home wiring system. In some embodiments it may be preferred for the power unit 410 to be an internal power source such as a battery, to allow the sensor 405 to be placed without regard for available power connections.

The luminaire 440 may be a large-area, general illumination device, or it may be a smaller-area device, such as an accent light, intended to provide limited illumination. The luminaire 440 includes at least one RGB OLED device that may be, for example, laterally or vertically patterned so that white light of a known temperature and CRI may be generated. The OLED may include separate drivers 460 for each set of red, green, and blue subpixels 470. As will be readily understood by one of skill in the art, light having one or more desired characteristics, such as a desired color, temperature, intensity, and/or pattern may be generated by driving the subpixels 470 in a combination to produce the desired light.

The wireless receiver 450 receives the signal sent by one or more wireless transmitters 420. As previously described with respect to the transmitter 420, the receiver 450 may be a Bluetooth(R), WiFi, or any other suitable wireless receiver or transceiver. A main control unit 455 may determine driving conditions of the red, green, and blue OLED subpixels based upon the light information received by the receiver 450. For example, where the signal specifies a particular color to be emitted by the luminaire 440, the main control unit may calculate the specific driving conditions for each subpixel 470 that are necessary to achieve the specified color. In an embodiment, the luminaire 440 may compare a spectrum received from the sensor 405 via the wireless receiver 450 to one or more known reference spectra 865. The main control unit may then select the closest match to the received spectrum, and cause the luminaire to emit light based upon the identified reference spectrum 865. In some cases, multiple reference spectra may be combined to produce a desired color. The reference spectra 865 also may be generated based upon the known characteristics of the reference surface 835, to allow for more efficient processing by the main control unit 455 based upon the data received from the sensor 405.

The main control unit 450 may interface with the subpixels via separate drivers 460, so as to independently control the luminosity of the red, green, and blue OLED subpixels. For example, the drivers 460 may include one or more power controllers configured to separately drive the red, green and blue OLED subpixels. The main control unit also may interface and control a mechanism for shading, obstructing or changing the angle of the red, green and blue OLEDs to achieve one or more desired light characteristic.

Figure 5:
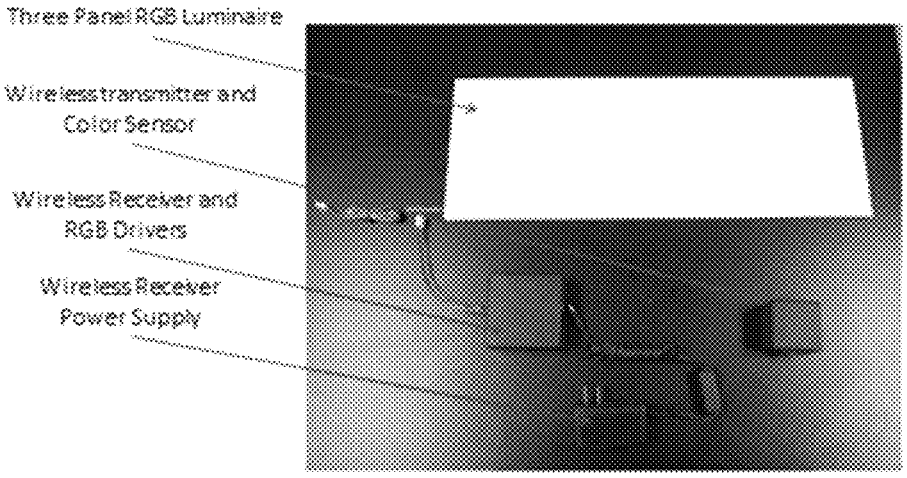
FIG. 5 shows a photograph of an example system including an RGB luminaire, a wireless receiver with power supply, and a wireless transmitter with color sensor according to an embodiment of the invention.
Figure 6:
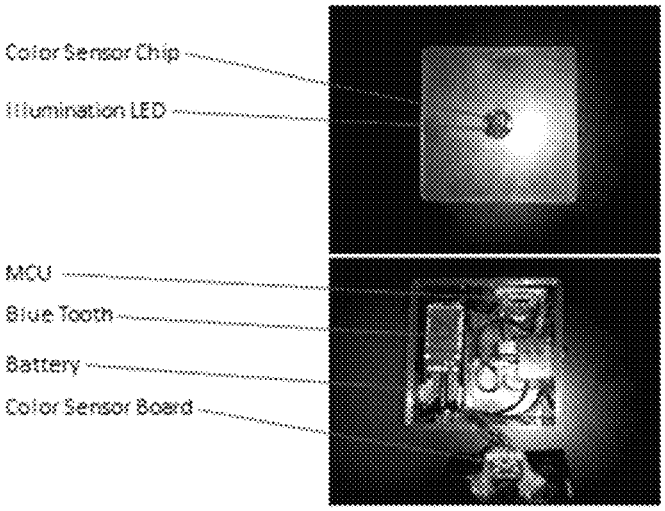
FIG. 6 shows an example of a transmitter unit including an aperture in a box through which a broadband source shines and a color sensor detects reflected light (top) and a color sensor board integrated with a broadband light source, a wireless transmitter, a main control unit (MCU), and a battery (bottom) according to an embodiment of the invention.
Figure 7:
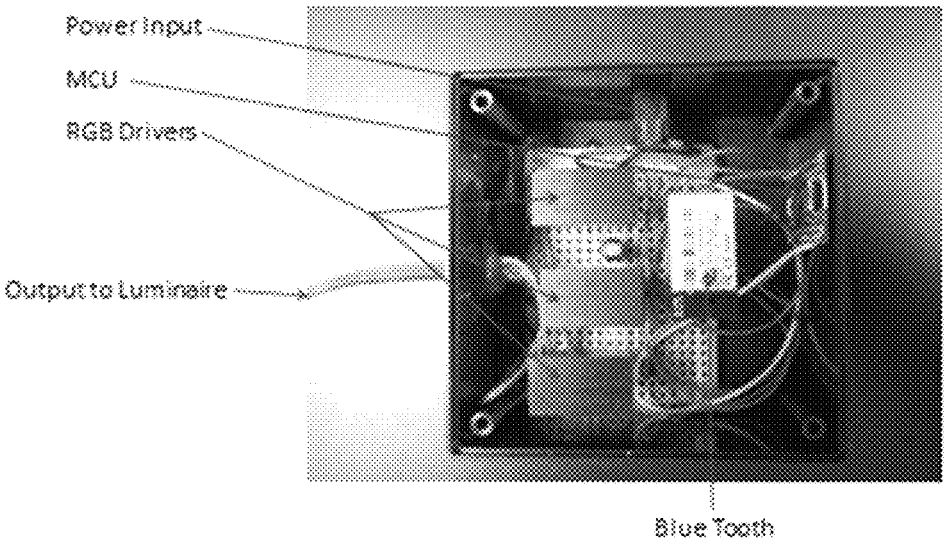
FIG. 7 shows an example of a receiver box including a wireless receiver, a main control unit (MCU), and OLED driver chips, including one driver chip for each color with independent outputs to an OLED luminaire, according to an embodiment of the invention.
Figure 9:
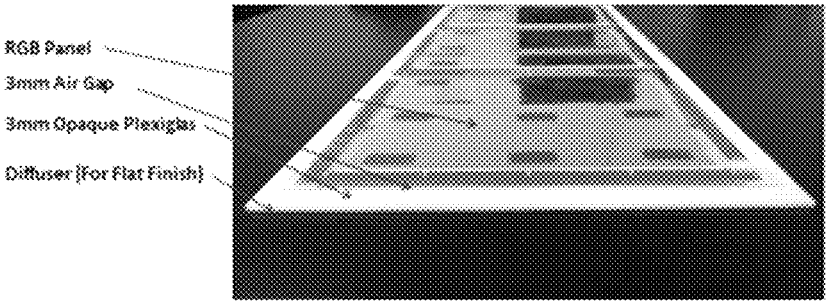
FIG. 9 shows an example luminaire that includes three OLED panels coupled to a diffuser according to an embodiment of the invention.

In an example experimental device shown in FIG. 5, three laterally-patterned OLED panels were mounted to an acrylic diffuser with sufficient diffusion to combine the three OLED colors into a single emitted color. Separate current drivers were used for the red, green and blue subpixels. The drivers were designed to supply a constant peak current, with pulse width modulation used to control the brightness of each subpixel. A parts list for the experimental device is provided in Table 1, below. FIG. 6 shows the experimental transmitter unit, including an aperture in a box through which a broadband source shines and a color sensor detects reflected light (top). The unit includes a color sensor board integrated with a broadband light source, a wireless transmitter, a main control unit (MCU), and a battery (bottom). FIG. 7 shows the experimental receiver including a wireless receiver, the main control unit, and OLED driver chips, including one driver chip for each color with independent outputs to the OLED luminaire. FIG. 9 shows the experimental luminaire panel, which includes three OLED panels coupled to a diffuser.

TABLE 1

Component list for demonstration device.

| | |
|---|---|
| Receiver MCU | Atmel ATMEGA328P-AUR |
| Bluetooth Slave | Roving Networks RN-42 |
| RGB drivers | RECOM RCD-24-1.00 |
| Transmitter MCU | Atmel ATMEGA328P-AUR |
| Color sensor | Avago Technologies ADJD-S311-CR999 |
| Bluetooth Master | Roving Networks RN-42 |

The systems disclosed herein may be used for a variety of applications. In an embodiment, a system such as that shown in FIG. 8 may be used to provide automatically balanced indoor lighting. The color sensor may be mounted indoors, and transmits the spectrum of illumination measured from the reference card to the luminaire. The MCU of the receiving unit then compares the measured spectrum to one of a set of standards stored in memory as previously described, and adjusts the output of the OLED until the measured spectrum matches the reference spectrum. Such a technique may have broad utility. For example, a room with both natural light from windows and artificial light from OLED luminaires may keep a balanced spectrum at a work surface regardless of the quality of light coming through the windows. More specifically, regardless of whether the light coming from outside varies from noon to sunset, or from bright sunshine to overcast, the color temperature of light at the work surface may be maintained at a constant, pre-determined value.

As another example, the system may be used when re-lamping a room or area. With current lighting technology, it is often necessary to re-lamp an entire room when a single lamp fails because the color temperature of a replacement lamp differs from that of the legacy installation, which may create dissonance in the lighting profile of the room. Using the system shown in FIG. 8 with a standard gray card, the new OLED lamp may automatically adjust itself to match the rest of the installation without user intervention, thereby eliminating color shifts due to aging and eliminating the need to re-lamp the entire room. As a specific example, a room may include several OLED luminaires configured to provide a desired color and/or temperature, or range of colors and temperatures, within the room. Upon failure of one of the luminaires, a replacement luminaire such as the luminaire 440 in FIG. 8 may be installed without regard to the default light characteristics provided by the replacement. When the new luminaire is installed, it may receive data from one or more sensors, such as the sensor 405 in FIG. 8, that specify characteristics of the light present in the rest of the room as provided by the other luminaires. As previously described, the replacement luminaire may then match the characteristics of its emitted light to those of the light present in the room.

Systems as disclosed herein also may be used to provide dynamic control of lighting quality. In an embodiment, the OLED luminaire may be mounted on a wall or ceiling. As previously disclosed, the luminaire may be battery powered or powered by a main electrical source. A color sensing unit may be wall-mounted in a convenient location such as near a door. Colored cards or objects may be presented to the color sensing unit, for example to provide the surface 435 shown in FIG. 4. The controller of the OLED luminaire may be programmed to mimic colors presented to the sensor in real time. As a specific example, the system may be used to control the quality of illumination in the room, such as where the illumination quality in the room is tunable from warm white to cool white by presenting the appropriate card to the color sensor, which produces the desired quality of light without requiring any understanding of the inputs required to generate that particular quality of light. Alternatively or in addition, a color sensing unit may be battery powered and completely portable, and colored lighting could be controlled by placing the unit on various colored surfaces. Such a configuration may provide an intuitive input system for the control of dynamic lighting, without requiring physical knobs, switches, dials or the like.

In a similar configuration, systems as disclosed herein may be used to provide daylight mimetic dynamic artificial lighting. In an embodiment, a sensor such as the sensor 405 in FIG. 8 may be used to measure the color of a reference card (e.g., white or standard gray) that may be held in a fixed relationship to the detector. The card and detector are placed outdoors. As the color temperature of daylight varies throughout the day, the color sensor measures the quality of the natural light reflecting off the reference card and transmits this information to the receiver that controls the OLED luminaire. The master control unit of the luminaire is programmed with the drive conditions required for the RGB OLEDs to reproduce the quality of light measured by the color sensing module. As a result, the indoor lighting mimics the natural progression of daylight outside. For example, the color temperature of daylight can vary from 10,000K from a sunny blue sky to below 3,000K at sunrise or sunset. Notably, such a technique may be used even in a location that lacks any windows onto the outside environment. Reproducing the outdoor lighting variation in indoor artificial lighting may enhance the circadian rhythm of those in the building and lead to greater comfort and happiness. In some configurations, the system may be configured to default to a pre-determined color temperature during periods of darkness.

As previously described, various wireless communication systems such as Bluetooth may be used to permit the sensor to control multiple luminaires in one or more rooms. This may provide for a henceforth unobtainable degree of lighting consistency in both space and time.

In an embodiment, individual OLED lamps may be designed to integrate together into a luminaire, with the MCU of each luminaire capable of controlling multiple OLED lamps. For example, in the demonstration device, three individual OLED lamps are coupled to a diffuser to make one luminaire as shown in FIG. 9. Such a configuration also may provide for designs in which the size of the OLED luminaire is not fixed, with additional panels being added or removed as desired. Panels may be added or removed without requiring any additional configuration by a user, because one or more MCUs may be pre-configured to control multiple luminaires.

Generally, OLED panels used in devices and systems disclosed herein may have any of the properties described herein and known in the art as being achievable for individual OLED panels. For example, luminaires disclosed herein may use transparent and/or flexible OLED, and may themselves be substantially or entirely transparent and/or flexible.

The light characteristics that may be measured and reproduced by systems disclosed herein may include color, texture, temperature, pattern, or other physical parameters. For example, a luminaire may receive data from one or more sensors that allows it to provide light that matches a desired color and temperature of another luminaire or of an outdoor region. As another example, an array of lamps on a ceiling may be configured into a checkerboard pattern by presenting such a pattern to the detector. As another example, the angular output of a luminaire may be changed by presenting various shades of color or physical shapes to the sensor, thus causing a physical motion of the luminaire panels or reflectors integrated into the luminaire.

It may be noted that driving an OLED as disclosed herein may be done using techniques different from driving other devices such as conventional LEDs. For example, it may be desirable for the control unit to have special functions to address unique properties of OLED devices. For example, the IVL (current-voltage-luminance) performance of an OLED may be quite different from other sources such as conventional LEDs. Even among different OLEDs, individual red, green, and blue devices may be quite different in their IVL performance. Thus, it may be desirable for the control unit to be configured to account for the IVL performance of individual RGB OLEDs into consideration. In other configurations, a sensor may be used as disclosed herein to allow the control unit to adjust the output of an OLED to achieve a desired color, thus inherently accounting for any difference in performance.

As another example, it is known that RGB OLEDs age at different speed. Thus, it may be desirable that the control unit is configured to account for different aging of individual colors.

It is understood that the various embodiments described herein are by way of example only, and are not intended to limit the scope of the invention. For example, many of the materials and structures described herein may be substituted with other materials and structures without deviating from the spirit of the invention. The present invention as claimed may therefore include variations from the particular examples and preferred embodiments described herein, as will be apparent to one of skill in the art. It is understood that various theories as to why the invention works are not intended to be limiting.

The invention claimed is:

1. A system comprising:

a sensor component comprising:

a remote sensor configured to measure a physical characteristic; and a wireless transmitter configured to provide a sensor signal based upon the physical characteristic, the sensor signal specifying a desired light characteristic; and a lighting component comprising:

an OLED;

a wireless receiver configured to receive the sensor signal in real-time; and a controller configured to provide a control signal to the OLED, the control signal specifying the desired light characteristic in real-time, and causing the OLED to emit light having the desired light characteristic.

2. The system of claim 1, wherein the OLED comprises a color-tunable OLED.

3. The system of claim 2, wherein the desired light characteristic comprises a desired color, and the control signal indicates at least one corresponding CIE coordinate.

4. The system of claim 1, wherein the desired light characteristic is an attribute selected from the group consisting of: a color, an intensity, a temperature and a pattern.

5. The system of claim 1, wherein the OLED is configured to emit light having the desired light characteristic by emitting light of a plurality of colors having an intensity distribution based upon a desired color.

6. The system of claim 1, said sensor component further comprising a reference reflector, wherein the physical characteristic is an attribute of light reflected by the reference reflector.

7. The system of claim 6, said sensor component further comprising a reference light source, wherein the physical characteristic is an attribute of the reference light reflected by the reference reflector.

8. The system of claim 1, wherein the sensor component is portable.

9. The system of claim 1, wherein the sensor comprises a battery power source.

10. The system of claim 1, further comprising a plurality of lighting components, each of the plurality of lighting components comprising:

an OLED;

a wireless receiver configured to receive a signal in real-time; and a controller configured to provide a control signal to the OLED specifying the desired light characteristic in real-time, the control signal causing the OLED to emit light having the desired light characteristic.

11. The system of claim 10, wherein the signal received by each wireless receiver is the sensor signal.

12. The system of claim 10 further comprising a replacement lighting component, wherein, upon addition of the replacement lighting component, the replacement lighting component is configured to receive the signal in real-time, and to emit light defined by the signal in real-time.

13. The system of claim 12, wherein the light defined by the signal is based upon light emitted by at least one of the plurality of lighting components.

14. The system of claim 10, further comprising a mechanism configured to position at least one of the plurality of lighting components to generate a visible pattern defined by the desired light characteristic.

15. The system of claim 1, wherein the OLED is flexible.

16. The system of claim 1, wherein the OLED is at least partially transparent.

17. The system of claim 1, wherein the OLED comprises a large-area OLED panel.

18. The system of claim 1, wherein the wireless transmitter and the wireless receiver communicate using the Bluetooth protocol.

19. The system of claim 1, wherein the physical characteristic is a characteristic of light in the region of the sensor component.

20. The system of claim 19, wherein the physical characteristic is selected from the group consisting of: color, temperature, and intensity.

21. The system of claim 1, wherein the OLED comprises at least two separate OLEDs with different spectrum characteristics.

22. The system of claim 21, wherein the at least two separate OLEDs are individually controllable.

23. A device comprising:

an OLED;

a wireless receiver configured to receive a signal from a remote sensor in real-time, the signal specifying a desired light characteristic resulting from an automatic measurement, by the sensor, of a physical characteristic measured by the remote sensor in real-time;

a controller configured to provide a control signal to the OLED specifying the desired light characteristic in real-time, the control signal causing the OLED to emit light having the desired light characteristic.

24. The device of claim 23, wherein the OLED comprises a color-tunable OLED.

25. The device of claim 23, wherein the OLED is configured to emit the desired light characteristic by emitting light of a plurality of colors having an intensity distribution based upon a desired color.

26. The system of claim 23, wherein the desired light characteristic is an attribute selected from the group consisting of: a color, an intensity, a temperature, and a pattern.

27. The device of claim 23, wherein the OLED is flexible.

28. The device of claim 23, wherein the OLED comprises a large-area OLED panel.

* * * * *